US008678759B2

(12) United States Patent
Sinzaki

(10) Patent No.: US 8,678,759 B2
(45) Date of Patent: Mar. 25, 2014

(54) CENTRIFUGAL FAN

(75) Inventor: Kouji Sinzaki, Aichi (JP)

(73) Assignee: Panasonic Corporation, Osaka (JP)

( * ) Notice: Subject to any disclaimer, the term of this patent is extended or adjusted under 35 U.S.C. 154(b) by 1110 days.

(21) Appl. No.: 12/668,547

(22) PCT Filed: Jun. 26, 2008

(86) PCT No.: PCT/JP2008/001664

§ 371 (c)(1),
(2), (4) Date: Jan. 11, 2010

(87) PCT Pub. No.: WO2009/011093

PCT Pub. Date: Jan. 22, 2009

(65) Prior Publication Data

US 2010/0183433 A1 Jul. 22, 2010

(30) Foreign Application Priority Data

Jul. 17, 2007 (JP) ..... 2007-185531

(51) Int. Cl.
*F04D 29/44* (2006.01)

(52) U.S. Cl.
USPC ..... 415/204; 415/206; 415/212.1

(58) Field of Classification Search
USPC ..... 415/204, 206, 207, 212.1, 224.5
See application file for complete search history.

(56) References Cited

U.S. PATENT DOCUMENTS

| | | | | |
|---|---|---|---|---|
| 1,109,393 | A * | 9/1914 | Blackstead | 415/204 |
| 2,780,490 | A * | 2/1957 | Knud | 239/561 |
| 3,098,603 | A * | 7/1963 | Baker | 415/204 |
| 3,732,030 | A * | 5/1973 | Mullings | 415/214.1 |
| 3,980,232 | A * | 9/1976 | Funk | 239/77 |
| 4,279,325 | A * | 7/1981 | Challis | 181/211 |
| D404,122 | S * | 1/1999 | Hayashi et al. | D23/370 |
| 6,314,894 | B1 * | 11/2001 | Gatley, Jr. | 110/341 |
| 6,342,005 | B1 * | 1/2002 | Daniels et al. | 454/338 |
| 6,460,364 | B1 * | 10/2002 | Tufo | 62/285 |
| 6,692,229 | B2 * | 2/2004 | Metz | 415/206 |
| 6,895,874 | B2 * | 5/2005 | Gatley, Jr. | 110/341 |
| 6,908,281 | B2 * | 6/2005 | Lyons et al. | 415/206 |
| 7,179,048 | B2 * | 2/2007 | Huang et al. | 415/126 |

FOREIGN PATENT DOCUMENTS

| | | |
|---|---|---|
| JP | 54-109611 A | 8/1979 |
| JP | 62-197799 U | 12/1987 |

(Continued)

OTHER PUBLICATIONS

International Search Report of PCT Application No. PCT/JP2008/001664 dated Sep. 30, 2008.

*Primary Examiner* — Edward Look
*Assistant Examiner* — Aaron R Eastman
(74) *Attorney, Agent, or Firm* — Panasonic Patent Center

(57) ABSTRACT

A centrifugal blower unit comprising an impeller disposed therein and a scroll casing covering the exterior, the scroll casing having an outlet port, a tongue-like portion, a scroll portion of a volute shape and side casing plates provided with inlet ports on both sides, featuring advantages of increasing a static pressure and reducing an input power and noise while also achieving compactness in size. The scroll portion is provided with tapered scroll walls formed in anti-tongue-side wall adjacent to the outlet port by having it bent along bent lines toward the impeller and at angles to a driving shaft of the impeller such that a cross sectional area of the scroll portion in a direction of the driving shaft becomes gradually smaller toward the side casing plates.

20 Claims, 8 Drawing Sheets

(56) References Cited

FOREIGN PATENT DOCUMENTS

| | | | |
|---|---|---|---|
| JP | 4-6600 | | 1/1992 |
| JP | 4-6600 | U | 1/1992 |
| JP | 10-299697 | A | 11/1998 |
| JP | 2005-248934 | | 9/2005 |
| JP | 2005-248934 | A | 9/2005 |

* cited by examiner

CENTRIFUGAL FAN

TECHNICAL FIELD

The present invention relates to a structure of centrifugal blower units for use in ventilation blowers such as duct fans, air conditioners and the like apparatuses.

BACKGROUND ART

A centrifugal blower unit of certain kind hitherto known comprises a scroll casing provided with an outlet port of a rectangular shape in cross section, and uses a flared air passage communicating between the outlet port and an air duct, the flared air passage having a rectangular shape in cross section with a height expanding continuously from one end connecting the outlet port toward the other end connecting the air duct (Patent literature 1, for example).

Referring now to FIG. 9 and FIG. 10, description is provided hereinafter of such centrifugal blower unit. FIG. 9 is a side view showing a structure of a conventional centrifugal blower unit, and FIG. 10 is a plan view of the same centrifugal blower unit.

As shown in FIG. 9 and FIG. 10, scroll casing 105 is provided with rectangular outlet port 101 having a height dimension H1 formed between anti-tongue-side wall 103 facing tongue-like portion 102 and tongue-side wall 104, and side casing plate 107 having inlet port 106 on each side of scroll casing 105. Centrifugal blower unit 109 is also provided with impeller 108 disposed inside scroll casing 105. Air duct 110 of a rectangular shape is formed into height H2, which is larger than height H1. Rectangular flared air passage 112 is formed between outlet port 101 and air duct 110 with wall surfaces 111 having length L. Wall surface 111 is sloped toward tongue-side wall 104 at an angle to a plane extended from anti-tongue-side wall 103 in a manner that a height of flared air passage 112 expands continuously from one end connecting outlet port 101 of height H1 toward the other end connecting air duct 110 of height H. Rectangular flared air passage 112 allows air to flow steadily in main-flow area 114 since one of wall surfaces 111 sloped at angle T to the plane extended from anti-tongue-side wall 103 toward tongue-side wall 104 is connected continuously to air duct 110 to reduce backflow area 113 inside air duct 110.

The conventional centrifugal blower unit of the above type can produce a steady airflow inside main-flow area 114 when width W1 of rectangular outlet port 101 and width W2 of rectangular air duct 110 are dimensionally equal. If width W2 is different from width W1, however, and leaves a difference in co-planarity from outlet port 101 to air duct 110 as shown in FIG. 10, it results in a loss of pressure and produces turbulent noise attributable to turbulent airflow 115 due to sudden expansion and collision of the flowing air, thereby decreasing a static pressure and increasing an input power and noise of centrifugal blower unit 109.

It is also known that centrifugal blower unit 109 generally produces side airflow 116 of a low velocity near the end plates of the casing, which tends to cause the direction of airflow unstable and produce turbulent airflow. The turbulent airflow induces back flow 117 at the edge of impeller 108 toward a space between impeller 108 and inlet port 106 near tongue-like portion 102, which also causes a loss of pressure and turbulent noise, thereby giving rise to problems of decreasing the static pressure and increasing the input power and the noise of centrifugal blower unit 109.

Patent Literature 1: Japanese Patent Unexamined Publication, No. 1998-299697

SUMMARY OF THE INVENTION

A centrifugal blower unit of the present invention comprises an impeller disposed therein, the impeller surrounded by an outlet port, a tongue-like portion in continuity to the outlet port, a scroll portion of a volute shape surrounding the periphery of the impeller and in continuity to the outlet port at the opposite side of the tongue-like portion, and side casing plates in continuity to the scroll portion and the outlet port and provided with an inlet port in an area confronting each side of the impeller. Also provided are tapered scroll walls formed between and at angles to both of the scroll portion and the side casing plates in locations adjacent to the outlet port. The tapered scroll walls are so formed that a distance to the tongue-like portion gradually becomes closer toward the side casing plates, and a width of the tapered scroll walls expands gradually toward the outlet port.

According to the present invention, the distance between the tapered scroll walls and the tongue-like portion becomes smaller gradually as they get closer to the side casing plates. This structure can increase a velocity of the airflow in areas near the side casing plates as compared to the airflow in the center area, and stabilize directions of the airflow around the side casing plates toward the outlet port along the tapered scroll walls. It thus becomes possible by virtue of this structure to increase a static pressure by reducing a loss of the pressure attributable to turbulent airflow, and decrease an input power and noise.

REFERENCE MARKS IN THE DRAWINGS

Figure 1:
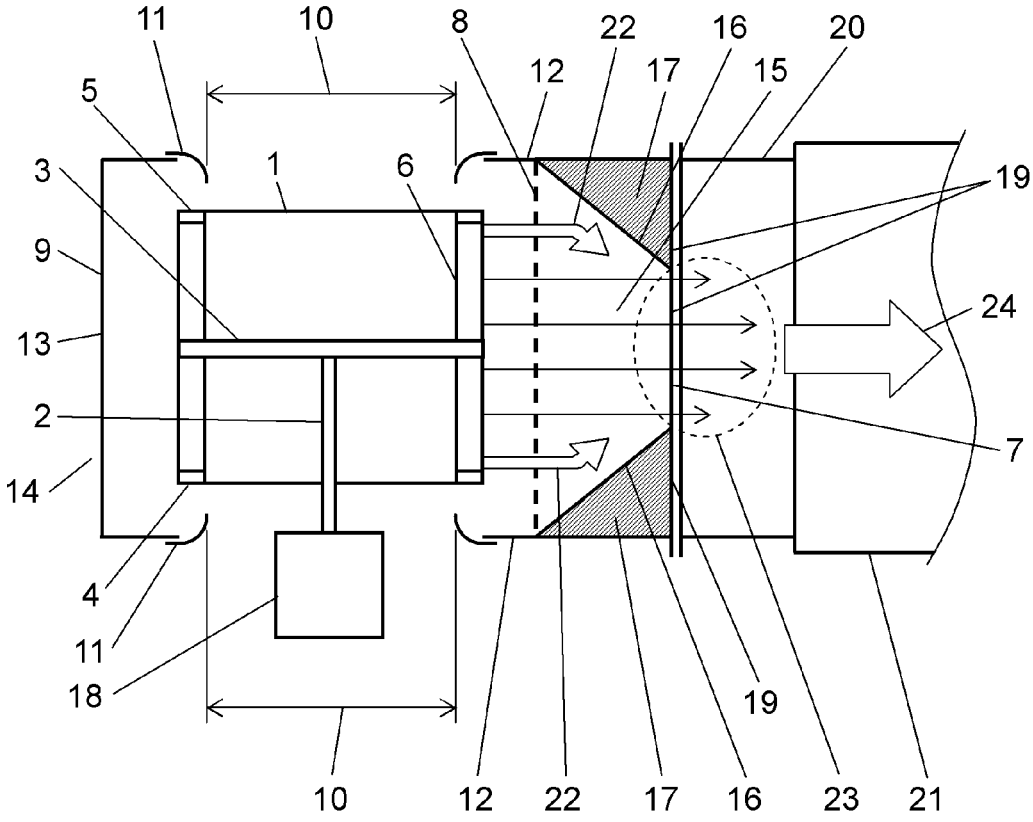
FIG. 1 is a plan view showing a structure of a centrifugal blower unit according to a first exemplary embodiment of the present invention.

1 Impeller
2 Driving shaft

7 Outlet port
8 Tongue-like portion
9 Scroll portion
10 Inlet port
12 Side casing plate
13 Scroll casing
14 Centrifugal blower unit
15 Anti-tongue-side wall
16 Bent line
17 Tapered scroll wall
18 Motor
19 Outlet port edge
20 Round adaptor
25 Tapered end
26 Curved surface
27 Taper-sided member
28 Main frame
29 Main-frame inlet port
30 Main-frame outlet port
35 Main-frame air passage
36 Duct fan
37 Width of main-frame air passage for smaller quantity of airflow
38 Width of main-frame air passage for larger quantity of airflow
39 Sound absorbing material

DETAILED DESCRIPTION OF PREFERRED EMBODIMENTS

Description is provided hereinafter of the preferred embodiments of the present invention with reference to the accompanying drawings.

First Exemplary Embodiment

Figure 2:
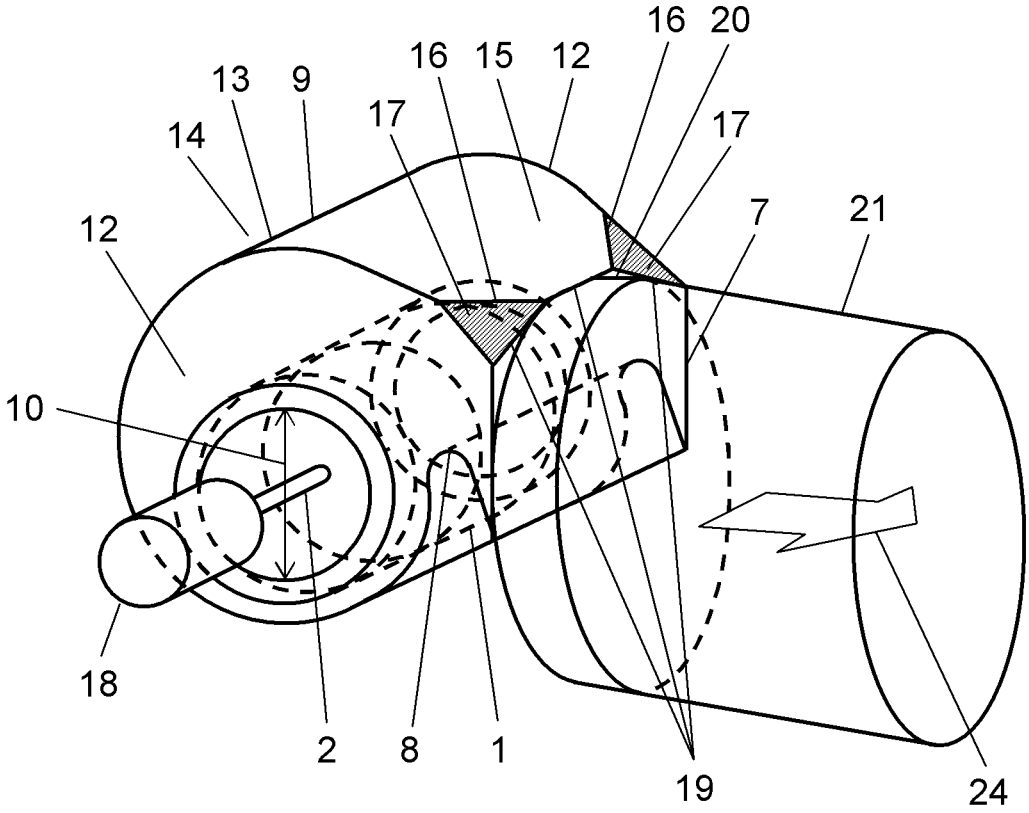
FIG. 2 is a perspective view showing the structure of the centrifugal blower unit according to the first exemplary embodiment of the present invention.

Referring now to FIG. 1 and FIG. 2 description is given of a centrifugal blower unit according to the first exemplary embodiment of the present invention. FIG. 1 is a plan view showing a structure of the centrifugal blower unit of the first exemplary embodiment of this invention, and FIG. 2 is a perspective view of the same. In this exemplary embodiment, impeller 1 of centrifugal blower unit 14 is a double suction type comprising disc-like main plate 3 connected to driving shaft 2 and a plurality of blades 6 bridged between annular motor-side end plate 4 and anti-motor-side end plate 5. Impeller 1 is driven and rotated by motor 18 via driving shaft 2. Provided in a manner to surround the exterior of impeller 1 are air outlet port 7, tongue-like portion 8 and scroll portion 9 of a volute shape in continuity to outlet port 7 at the opposite side of tongue-like portion 8. Also provided at both sides of impeller 1 are side casing plates 12, each having inlet port 10 formed into a shape of orifice 11. The components surrounding the external periphery of impeller 1, or outlet port 7, tongue-like portion 8, scroll portion 9, side casing plates 12 and the like constitute scroll casing 13. Scroll casing 13 is provided with tapered scroll walls 17 formed by having parts of scroll portion 9 bent along bent lines 16 toward impeller 1 at angles to driving shaft 2 of impeller 1 in areas of anti-tongue-side wall 15 adjacent to outlet port 7 and opposite to tongue-like portion 8. In other words, tapered scroll walls 17 of slant surfaces are formed between scroll portion 9 and side casing plates 12 adjacent to outlet port 7. Distances between inner surfaces of the tapered scroll walls 17 and confronting inner surfaces of tongue-like portion 8 gradually become smaller toward the side casing plates. The tapered scroll walls 17 are shaped to have inner surfaces which gradually expand toward the outlet port.

Round adaptor 20 of a circular shape in cross section is connected to outlet port 7 in a manner so that the circular end of round adaptor 20 is generally aligned with outlet port edge 19 consisting of tongue-like portion 8, anti-tongue-side wall 15 and tapered scroll walls 17. Round adaptor 20 is connected in communication with round duct 21.

When centrifugal blower unit 14 is operated, it produces an airflow consisting of side airflow 22 near the side casing plates and main airflow 23 in the center of the casing, as may be categorized broadly, and a merged current of these airflows is delivered as discharge airflow 24.

Centrifugal blower unit 14 tends to produce turbulent airflow due to instability in the direction of airflow since side airflow 22 near the side casing plates is generally low in the velocity. The turbulent airflow induces a back flow at the edge of impeller 1 toward a space between impeller 1 and inlet port 10 near tongue-like portion 8, which causes a loss of pressure and turbulent noise, thereby giving rise to a problem of decreasing a static pressure and increasing an input power and noise of centrifugal blower unit 14. To cope with this problem, the above structure has an air delivering space so configured that the areas near side casing plates 12 where tapered scroll walls 17 are formed are narrower than the center area as observed in cross section. This structure accelerates the velocity of airflow near side casing plates 12 to bring it faster than that of the center area when compared with the conventional centrifugal blower unit. In other words, this structure can increase the velocity of side airflow 22 near the side casing plates by virtue of slant tapered scroll walls 17 formed between scroll portion 9 and side casing plates 12 adjacent to outlet port 7. In addition, tapered scroll walls 17 can stabilize the direction of the airflow by guiding side airflow 22 near the side casing plates toward the center of outlet port 7 since the widths of tapered scroll walls 17 expand gradually toward the outlet port of the air to help prevent turbulent airflow attributable to a difference in the surface co-planarity. It thus becomes possible by virtue of the above structure to prevent the turbulent airflow, reduce the loss of pressure and avoid the turbulent noise around outlet port 7.

Figure 9:
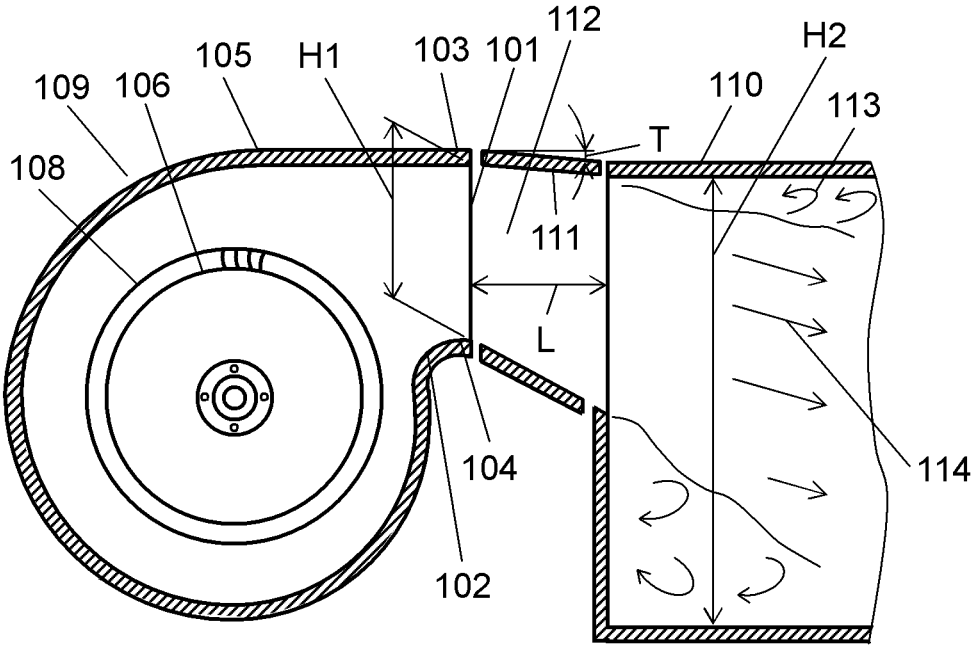
FIG. 9 PRIOR ART
FIG. 9 is a side view showing a structure of a conventional centrifugal blower unit.
Figure 10:
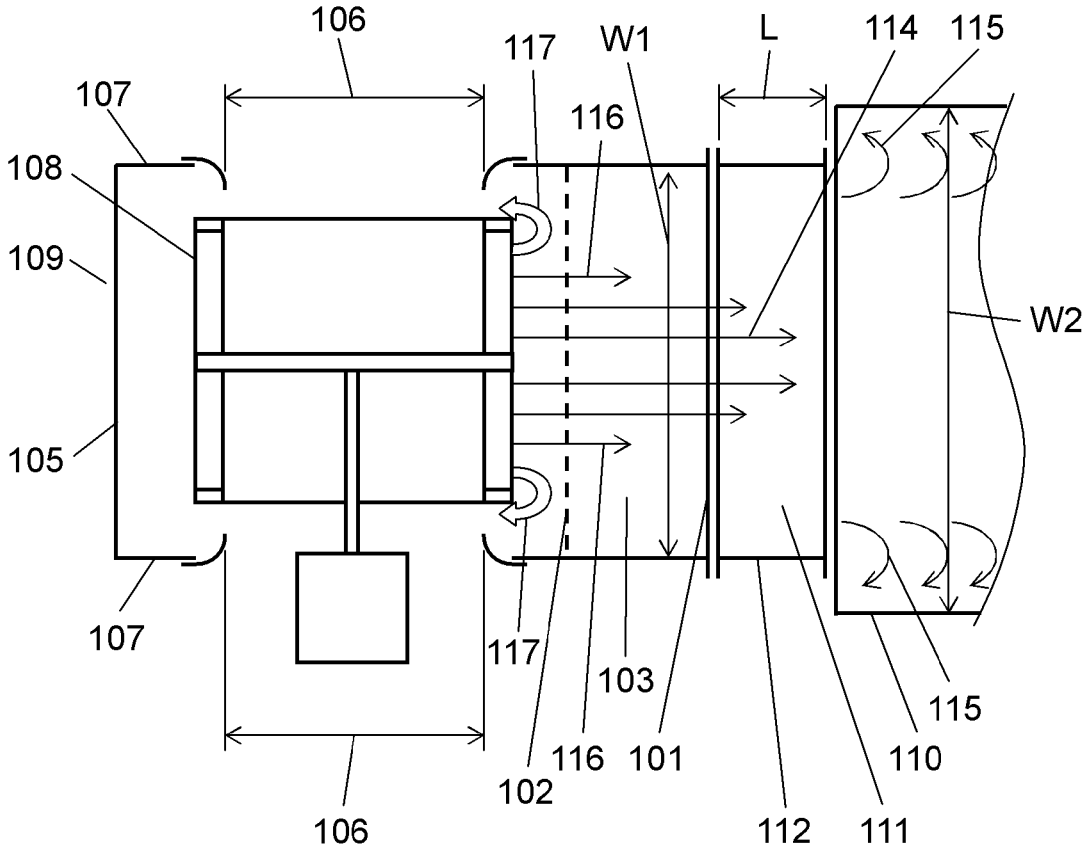
FIG. 10 PRIOR ART
FIG. 10 is a plan view showing the structure of the conventional centrifugal blower unit.

It is common practice to use round ducts for the sake of their good workability and space-saving size when installing a centrifugal blower unit of small size having a relatively small capacity, and it therefore becomes necessary to provide means of connection with round adaptors of a circular cross section. In the case of the conventional centrifugal blower unit, however, rectangular flared air passage 112 of FIG. 9 cannot be connected continuously with a round duct without leaving a difference in co-planarity from outlet port 101 to the round duct, thereby giving rise to a problem of decreasing a static pressure and increasing an input power and noise of centrifugal blower unit 109 due to a loss of pressure and turbulent noise attributable to turbulent airflow caused by sudden expansion and collision of the flowing air.

In this exemplary embodiment, outlet port edge 19 configured of anti-tongue-side wall 15 and tapered scroll walls 17 of scroll portion 9 is tapered from the center part toward side casing plates 12 in a manner to reduce the opening and to form outlet port 7 of a polygonal shape. Outlet port edge 19 thus has a curvature generally resembling that of round adaptor 20, which can reduce the difference in co-planarity of the air passage from outlet port 7 to round adaptor 20, and it thereby prevents the turbulent airflow around outlet port 7, reduces the loss of pressure and the airflow noise.

In this exemplary embodiment, although centrifugal blower unit 14 is illustrated as having impeller 1 of the double suction type, the invention can be embodied in any blower unit even with an impeller of single suction type to exhibit like features and advantages.

According to the first exemplary embodiment of this invention, the centrifugal blower unit has the advantages of reducing the loss of pressure attributable to the turbulent airflow, increasing the static pressure and decreasing the input power and noise.

Second Exemplary Embodiment

Figure 3:
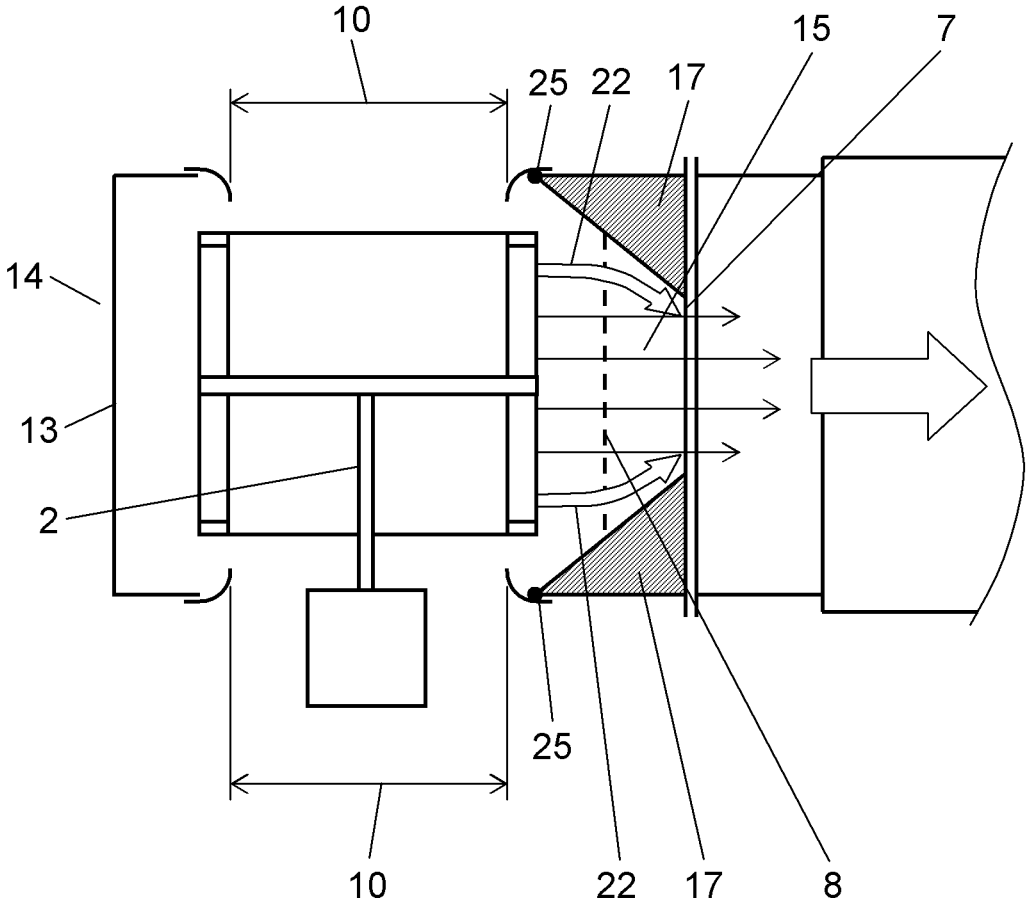
FIG. 3 is a plan view showing a structure of a centrifugal blower unit according to a second exemplary embodiment of the present invention.
Figure 4:
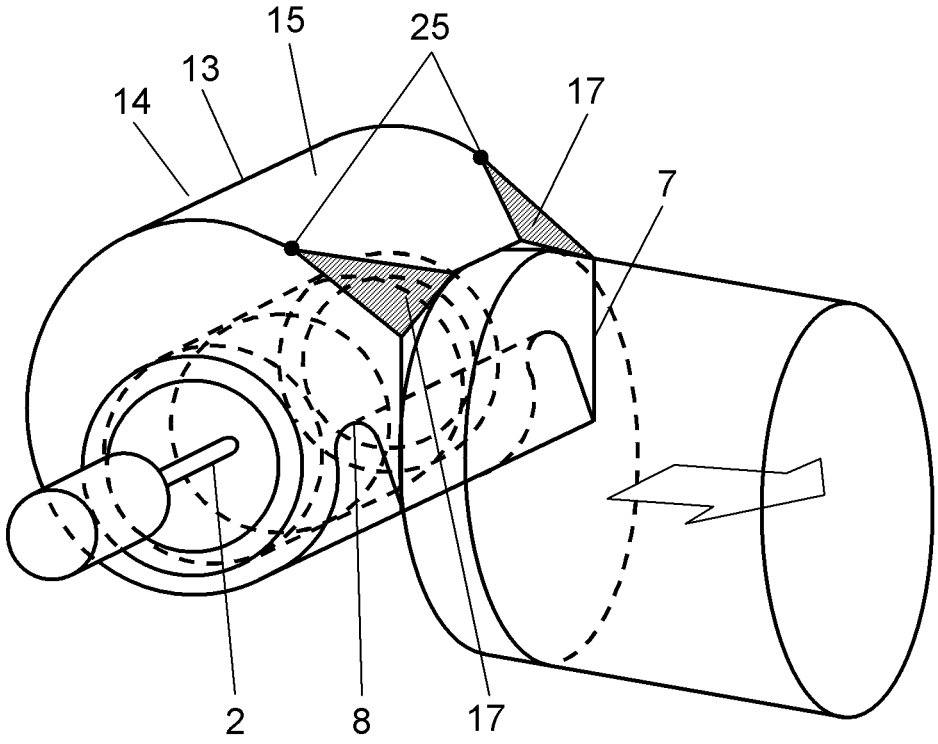
FIG. 4 is a perspective view showing the structure of the centrifugal blower unit according to the second exemplary embodiment of the present invention.

FIG. 3 is a plan view showing a structure of a centrifugal blower unit of the second exemplary embodiment of the present invention, and FIG. 4 is a perspective view of the structure of the same centrifugal blower unit of this exemplary embodiment. As shown in FIG. 3 and FIG. 4, tapered scroll walls 17 are formed with their tapered ends 25 at the opposite side of the outlet port extended to points within an area of scroll portion 9 between one side corresponding to tongue-like portion 8 and the other side confronting driving shaft 2 as viewed from above scroll portion 9. The one side corresponding to tongue-like portion 8 as viewed from above scroll portion 9 means a lateral part on the surface of scroll portion 9 wherefrom a perpendicular plane extended to tongue-like portion 8 becomes closest. In FIG. 3, the part of tongue-like portion 8 closest to scroll portion 9 is shown by dotted line. The lateral part on scroll portion 9 corresponding to the dotted line is hence defined as the side corresponding to tongue-like portion 8. Likewise, the other side confronting driving shaft 2 means a lateral part on the surface of scroll portion 9 where another plane containing driving shaft 2 and parallel to the plane indicated by the dotted line intersects scroll portion 9.

Moreover, an expansion space in scroll portion 9 is so configured that an expanding rate of scroll portion 9 is gradually decreased toward both side casing plates 12. Here, the expansion space in scroll portion 9 means a part of space formed by scroll portion 9, blades 6 and side casing plates 12, wherein a cross sectional area for the air to flow expands gradually. The expanding rate means a rate of change in distance from the periphery of blades 6 of impeller 1 to scroll portion 9, or in the space near the outlet port, it also means a rate of change in distance from a plane containing blades 6 and tongue-like portion 8 to scroll portion 9. In this exemplary embodiment, a degree of expansion (i.e., the expanding rate of the scroll) is largest in the center part of scroll portion 9 (i.e., the intermediate area between side casing plates 12 on the both sides), and the degree of expansion is decreased toward side casing plates 12.

In general, centrifugal blower unit 14 tends to produce turbulent airflow due to instability in the direction of airflow since side airflow 22 near the side casing plates is low in the velocity. The turbulent airflow induces a back flow at the edge of impeller 1 near tongue-like portion 8 toward a space between impeller 1 and inlet port 10. In this respect, the above structure has tapered scroll walls 17 formed with their tapered ends 25 at the opposite side of the outlet port extended to the points within the area between one side corresponding to tongue-like portion 8 and the other side corresponding to driving shaft 2 as viewed from anti-tongue-side wall 15. The above structure can accelerate the velocity of side airflows 22 adjacent to the side casing plates and tongue-like portion 8, and prevent the back flow at the edge of impeller 1 near tongue-like portion 8. The above structure can thus prevent the turbulent airflow near outlet port 7, and reduce the loss of pressure and the turbulent airflow noise.

While this structure has scroll portion 9 of such a configuration that the expanding rate is decreased gradually toward both side casing plates 12, the expanding space in the center part of scroll portion 9 not provided with tapered scroll wall 17 expands gradually toward the downstream of the airflow. The configuration is also such that the expanding space in scroll portion 9 near where tapered scroll walls 17 are provided with and where side airflow 22 passes through is expanded gradually. Since the expanding rate is varied gradually in a continuous manner over the entire space, this structure can accelerate the velocity of side airflows 22 adjacent to the side casing plates and tongue-like portion 8 and prevent the back flow at the edge of impeller 1 near tongue-like portion 8 while also attaining the effect of scroll portion 9 to transform the dynamic pressure generated by the rotation of impeller 1 into a static pressure throughout the entire space in the lateral direction of scroll portion 9. It can hence prevent the turbulent airflow near outlet port 7, and reduce the loss of pressure and the turbulent airflow noise.

In addition, this structure can include tapered scroll walls 17 compactly within the limited length of scroll casing 13 by positioning tapered ends 25 at the opposite side of the outlet port closer to driving shaft 2.

According to this second exemplary embodiment of the present invention, the centrifugal blower unit has advantages of reducing the loss of pressure attributable to the turbulent airflow, increasing the static pressure and decreasing the input power and noise while also achieving the compactness in size.

Third Exemplary Embodiment

Figure 5:
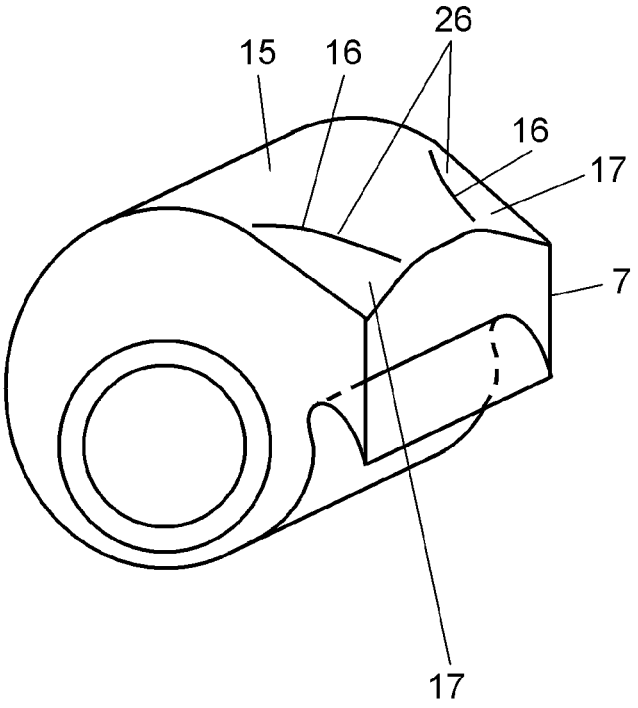
FIG. 5 is a perspective view showing a structure of a centrifugal blower unit according to a third exemplary embodiment of the present invention.

FIG. 5 is a perspective view showing a structure of a centrifugal blower unit of the third exemplary embodiment of the present invention. As shown in FIG. 5, bent lines 16 are formed into rounded shapes to provide curved surfaces 26 in any of tapered scroll walls 17 and anti-tongue-side wall 15.

The above structure makes use of curved surfaces 26 to form a smooth continuation between tapered scroll walls 17 and anti-tongue-side wall 15, and stabilizes the direction of airflow by deflecting the airflow near tapered scroll walls 17 smoothly along the walls toward the center area of outlet port 7. This structure can thus prevent turbulent airflow around outlet port 7, reduces a loss of pressure and airflow noise.

According to the third exemplary embodiment of this invention, the centrifugal blower unit has advantages of reducing the loss of pressure attributable to the turbulent airflow, increasing a static pressure and decreasing an input power and noise.

Fourth Exemplary Embodiment

Figure 6:
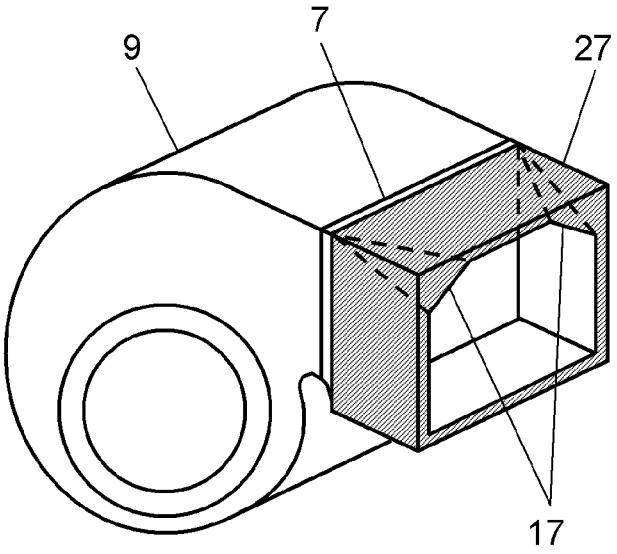
FIG. 6 is a perspective view showing a structure of a centrifugal blower unit according to a fourth exemplary embodiment of the present invention.

FIG. 6 is a perspective view showing a structure of a centrifugal blower unit according to the fourth exemplary embodiment of the present invention. The blower unit is provided with taper-sided member 27 having tapered scroll walls 17 formed therein as a separate component from scroll portion 9, and disposed on outlet port 7, as shown in FIG. 6. Taper-sided member 27 is fabricated preferably of a material such as a moldable plastic or a sound absorbing material as a separate component. This can simplify the shape of scroll portion 9, and make tapered scroll walls 17 freely formable in any three-dimensional shape.

According to the fourth exemplary embodiment of this invention, the centrifugal blower unit has advantages of increasing a static pressure and decreasing an input power and noise while also improving productivity of the scroll casing.

Notwithstanding this exemplary embodiment, scroll portion 9, tapered scroll walls 17, side casing plates 12, tongue-like portion 8 and the like need not be fabricated individually with a single sheet of plate. To this contrary, some of the above components may be fabricated into a single unit by bending and the like processes.

Fifth Exemplary Embodiment

Figure 7:
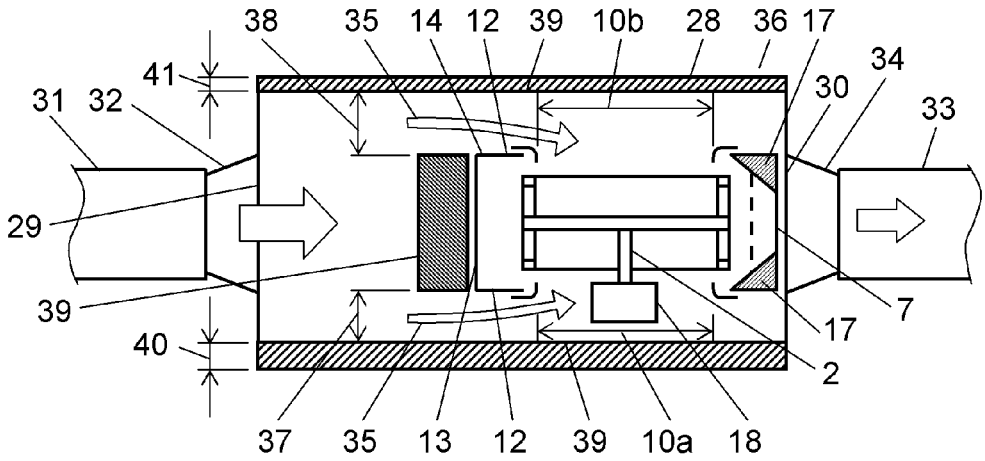
FIG. 7 is a plan view showing a structure of a duct fan equipped with a centrifugal blower unit according to a fifth exemplary embodiment of the present invention.

FIG. 7 is a plan view showing a structure of a duct fan equipped with a centrifugal blower unit according to the fifth exemplary embodiment of the present invention. As shown in FIG. 7, main frame 28 of a box-like shape has main-frame inlet port 29 and main-frame outlet port 30 on the two confronting sides. Main frame 28 is also provided with inlet adaptor 32 for connection of intake-side duct 31 to main-frame inlet port 29 and outlet adaptor 34 for connection of outlet-side duct 33 to main-frame outlet port 30. Duct fan 36 is composed by building centrifugal blower unit 14 into main frame 28 in a manner to connect outlet port 7 with main-frame outlet port 30 and to form main-frame air passages 35 between main frame 28 and centrifugal blower unit 14.

With regard to the widths of two main-frame air passages 35 formed between main frame 28 and side casing plates 12 of centrifugal blower unit 14, duct fan 36 may be so configured that width 38 of one of the main-frame air passages communicating with inlet port 10*b* on the anti-motor side where a large quantity of air flows through is set larger than width 37 of the other main-frame air passage where a quantity of the flowing air is smaller due to collision of the air to motor 18 connecting driving shaft 2, although not illustrated precisely in the figure.

This structure may be provided with sound absorbing material 39 disposed on any of an inner surface of main frame 28 and an outer surface of scroll casing 13. It is also possible to adjust a difference between width 37 of the main-frame air passage for smaller quantity of the airflow and width 38 of the main-frame air passage for larger quantity of the airflow by providing a difference between thickness 40 of the sound absorbing material at width 37 side of the main-frame air passage and thickness 41 of the sound absorbing material at width 38 side of the main-frame air passage although not exactly illustrated in the figure.

Figure 8:
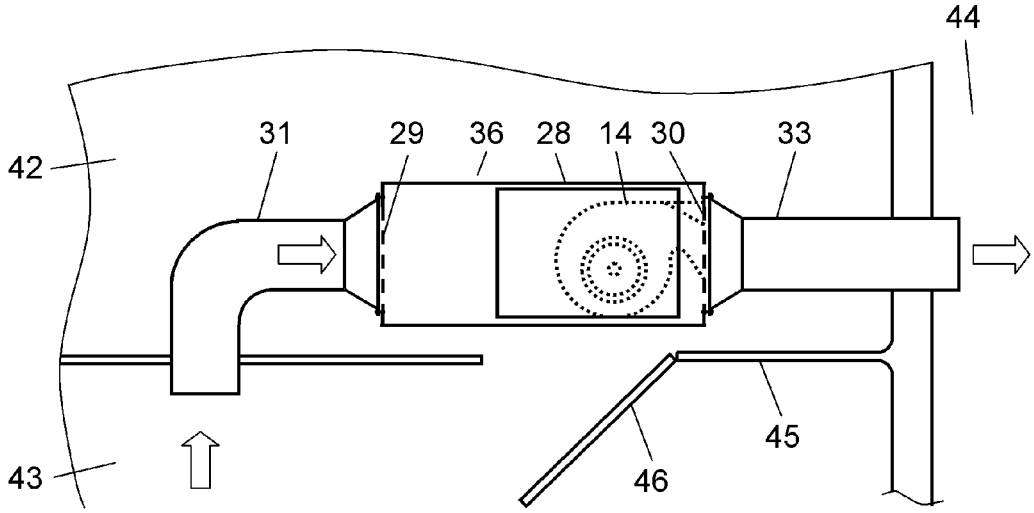
FIG. 8 is a side view showing the duct fan equipped with the centrifugal blower unit of the fifth exemplary embodiment as it is installed.

FIG. 8 is a side view showing a normal state of installation of the duct fan equipped with the centrifugal blower unit in the fifth exemplary embodiment. In the state of actual use, duct fan 36 is installed in ceiling space 42 with intake-side duct 31 connected to main-frame inlet port 29 and outlet-side duct 33 connected to main-frame outlet port 30 as shown in FIG. 8. When centrifugal blower unit 14 is operated, it takes air inside room 43 from inlet-side duct 31, passes the air through it and exhausts to outdoor 44 via outlet-side duct 33. Ceiling board 45 separates ceiling space 42 from room 43, and it is provided with ceiling inspection opening 46 under duct fan 36.

The above structure can prevent turbulent airflow around outlet port 7 of centrifugal blower unit 14 and reduce a loss of pressure. This effect of preventing the turbulence and associated airflow noise can make centrifugal blower unit 14 generate its ability efficiently without increasing a capacity of centrifugal blower unit 14 for compensation of the loss of pressure in main-frame air passages 35 of duct fan 36.

Duct fan 36 can also reduce the loss of pressure in main-frame air passages 35 leading to inlet ports 10 (not shown) of centrifugal blower unit 14 by virtue of the structure that one of main-frame air passages 35 is widened according to the quantity of the air flowing therethrough to reduce the air velocity, thereby suppressing the turbulent noise by the effect of the reduced velocity. In addition, tapered scroll walls 17 (not shown) can increase the velocity of side airflows 22 (not shown) near the side casing plates and stabilize the direction of the airflows by guiding side airflows 22 near the side casing plates toward the center of outlet port 7 (not shown) even though the velocity of the air flowing into inlet ports 10 (not shown) of centrifugal blower unit 14 is reduced by the reduction of the air velocity in main-frame air passages 35. Accordingly, the above structure can prevent the turbulent airflow near outlet port 7 (not shown), reduce the loss of pressure and the turbulent noise, and generate a static pressure without increasing the capacity of centrifugal blower unit 14.

Moreover, sound absorbing material 39 (not shown) can absorb the noise in main-frame air passages 35.

Since the more compact centrifugal blower unit 14 the thinner it can be to reduce the height of main frame 28, this duct fan can reduce a height of ceiling space 42 to provide an additional height in the space of room 27.

It is also obvious that the above structure improves maintainability such that it helps ease the work of removing centrifugal blower unit 14 when requiring the maintenance even when ceiling inspection opening 46 has a small size.

What has been described in this exemplary embodiment is a common example, wherein the main-frame air passage at the side of motor 18 is regarded as carrying a smaller quantity of air due to collision of the air against motor 18 and noted it as having width 37 for the smaller quantity of airflow. However, like advantageous effects are achievable even if the main-frame air passage at the side of motor 18 is provided with width 38 for the larger quantity of airflow for the designing reason of cooling off motor 18.

According to the fifth exemplary embodiment of this invention, the centrifugal blower unit has advantages of increasing the static pressure and decreasing the input power and noise of the duct fan while also achieving the compactness in size.

It should be understood that the present invention is intended to cover the techniques related to controlling the flow of air smoothly inside the blower unit, and it is characterized by having unique internal shapes for the air to pass therethrough. It is therefore not intended to restrict or specify external shapes of any of the structural elements.

INDUSTRIAL APPLICABILITY

Centrifugal blower units of the present invention are suitable for delivering air in such apparatuses as ventilation blower units, air conditioners, dehumidifiers, humidifiers and air cleaners. The centrifugal blower unit can ensure a sufficient quantity of airflow with a low loss of pressure, and it can be built compactly into any apparatus when used for cooling the apparatus by the air delivered from the main-frame outlet port. The centrifugal blower unit is hence useful for ventilating air in any kind of apparatus.

The invention claimed is:

1. A centrifugal blower unit comprising:

an impeller;

a scroll portion of a volute shape surrounding a periphery of the impeller;

a tongue-like portion continuously connected to an outlet port of the scroll portion; and a side casing plate connected to the scroll portion and the outlet port, and provided with an inlet port at a side of the impeller, wherein:

the centrifugal blower unit is provided with a tapered scroll wall of a slant surface formed between the scroll portion and the side casing plate in areas adjacent to the outlet port, a distance of the tapered scroll wall to the tongue-like portion gradually becomes smaller toward the side casing plate, a width of the tapered scroll wall expands gradually toward the outlet port, the centrifugal blower unit is further provided with an outlet port edge comprising the tongue-like portion, an anti-tongue-side wall and the tapered scroll wall, and the anti-tongue-side wall and the tapered scroll wall of the outlet port edge are configured to form the outlet port in a polygonal shape so that the opening of the outlet port is reduced toward the side casing plate.

2. The centrifugal blower unit of claim 1, wherein the tapered scroll wall has its tapered end at a point within an area of scroll portion between one side corresponding to the tongue-like portion and the other side confronting a driving shaft as viewed from the scroll portion.

3. The centrifugal blower unit of claim 1, wherein the centrifugal blower unit has a portion so constructed in the vicinity of the tongue-like portion that an expanding rate of the scroll portion is gradually decreased toward the side casing plate.

4. The centrifugal blower unit of claim 1, wherein a round adaptor of a circular shape in cross section is connected to the outlet port in a manner that a circular end of the round adaptor is brought into alignment with an outlet port side edge of the scroll portion and an outlet port side edge of the tapered scroll wall.

5. The centrifugal blower unit of claim 1, wherein the impeller has a double suction type structure.

6. The centrifugal blower unit of claim 1, wherein a main frame of a box-like shape is provided with a main-frame inlet port and a main-frame outlet port confronting each other, the outlet port of the centrifugal blower unit is connected to the main-frame outlet port, and at least two main-frame air passages are formed between the main frame and the centrifugal blower unit, so that a duct fan is formed by the main frame.

7. The centrifugal blower unit of claim 6, wherein two of the main-frame air passages formed between the main frame and the side casing plates of the centrifugal blower unit are so configured that one of the main-frame air passages communicating with the inlet port on an anti-motor side, where a quantity of air flowing therethrough is larger, has a width set larger than a width of the other main-frame air passage, where a quantity of air flowing therethrough is smaller due to collision of the air to a motor connecting a driving shaft.

8. The centrifugal blower unit of claim 6, wherein a sound absorbing material is disposed on one of an inner surface and an outer surface at one of the scroll portion, the side casing plates, the tongue-like portion and the outlet port.

9. A centrifugal blower unit comprising:

an impeller;

a scroll portion of a volute shape surrounding a periphery of the impeller;

a tongue-like portion continuously connected to an outlet port of the scroll portion; and a side casing plate connected to the scroll portion and the outlet port, and provided with an inlet port at a side of the impeller, wherein:

the centrifugal blower unit is provided with a tapered scroll wall of a slant surface formed between the scroll portion and the side casing plate in areas adjacent to the outlet port, a distance of the tapered scroll wall to the tongue-like portion gradually becomes smaller toward the side casing plate, a width of the tapered scroll wall expands gradually toward the outlet port, the tapered scroll wall is formed by having the scroll portion bent along a bent line into a rounded shape, and a curved surface is provided in one of the tapered scroll wall and a surface of the scroll portion facing the tongue-like portion.

10. A centrifugal blower unit comprising:

an impeller;

a scroll portion of a volute shape surrounding a periphery of the impeller;

a tongue-like portion continuously connected to an outlet port of the scroll portion;

a side casing plate connected to the scroll portion and the outlet port, and provided with an inlet port at a side of the impeller; and a taper-sided member having a tapered scroll wall, the taper-sided member being a different component from the scroll portion, and disposed on the outlet port, the tapered scroll wall including a slant surface formed on an interior of the taper-sided member, the tapered scroll wall configured so that a distance between the tapered scroll wall and the tongue-like portion gradually becomes smaller toward the scroll portion, and a width of the tapered scroll wall expands gradually toward the outlet port.

11. A centrifugal blower unit comprising:

an impeller;

a scroll portion of a volute shape surrounding a periphery of the impeller;

a tongue-like portion continuously connected to an outlet port of the scroll portion; and a side casing plate connected to the scroll portion and the outlet port, and provided with an inlet port at a side of the impeller, wherein:

a top surface of the scroll portion includes tapered scroll walls in areas adjacent to the outlet port, the tapered scroll walls configured so that a distance between the tapered scroll walls and the tongue-like portion gradually become smaller toward the side casing plate, and a width of the tapered scroll walls expand gradually toward the outlet port.

12. The centrifugal blower unit of claim 11, wherein the tapered scroll walls has its tapered end at a point within an area of scroll portion between one side corresponding to the tongue-like portion and the other side confronting a driving shaft as viewed from the scroll portion.

13. The centrifugal blower unit of claim 11, wherein the centrifugal blower unit has a portion so constructed in the vicinity of the tongue-like portion that an expanding rate of the scroll portion is gradually decreased toward the side casing plate.

14. The centrifugal blower unit of claim 11, wherein a round adaptor of a circular shape in cross section is connected to the outlet port in a manner that a circular end of the round adaptor is brought into alignment with an outlet port side edge of the scroll portion and an outlet port side edge of the tapered scroll walls.

15. The centrifugal blower unit of claim 11, wherein the impeller has a double suction type structure.

16. The centrifugal blower unit of claim 11, wherein the tapered scroll walls is formed by having the scroll portion bent along a bent line into a rounded shape, and a curved surface is provided in one of the tapered scroll walls and a surface of the scroll portion facing the tongue-like portion.

17. The centrifugal blower unit of claim 11, wherein a main frame of a box-like shape is provided with a main-frame inlet port and a main-frame outlet port confronting each other, the outlet port of the centrifugal blower unit is connected to the main-frame outlet port, and at least two main-frame air passages are formed between the main frame and the centrifugal blower unit, so that a duct fan is formed by the main frame.

18. The centrifugal blower unit of claim 17, wherein two of the main-frame air passages formed between the main frame and the side casing plates of the centrifugal blower unit are so configured that one of the main-frame air passages communicating with the inlet port on an anti-motor side, where a quantity of air flowing therethrough is larger, has a width set larger than a width of the other main-frame air passage, where a quantity of air flowing therethrough is smaller due to collision of the air to a motor connecting a driving shaft.

19. The centrifugal blower unit of claim 17, wherein a sound absorbing material is disposed on one of an inner surface and an outer surface at one of the scroll portion, the side casing plates, the tongue-like portion and the outlet port.

20. A centrifugal blower unit comprising:

an impeller;

a scroll portion of a volute shape surrounding a periphery of the impeller;

a tongue-like portion continuously connected to an outlet port of the scroll portion;

a side casing plate connected to the scroll portion and the outlet port, and provided with an inlet port at a side of the impeller; and a taper-sided member having tapered scroll walls, the taper-sided member being a different component from the scroll portion, and disposed on the outlet port, the tapered scroll walls including a slant surface formed on an interior of the taper-sided member, the tapered scroll walls configured so that a distance between the tapered scroll walls and the tongue-like portion gradually becomes smaller toward the scroll portion, and a width of the tapered scroll walls expands gradually toward the outlet port.

* * * * *